US006158378A

United States Patent [19]

Tsumiyama et al.

[11] Patent Number: 6,158,378

[45] Date of Patent: Dec. 12, 2000

[54] DECK FLOOR FOR PERSONAL WATERCRAFT

[75] Inventors: Yoshinori Tsumiyama, Miki; Kenichi Nakagawa, Kobe, both of Japan

[73] Assignee: Kawasaki Jukogyo Kabushiki Kaisha, Kobe, Japan

[21] Appl. No.: 09/303,665

[22] Filed: May 3, 1999

[30] Foreign Application Priority Data

May 26, 1998 [JP] Japan ..... 10-144159

[51] Int. Cl.[7] ..... B63B 17/00

[52] U.S. Cl. ..... 114/363; 114/55.55

[58] Field of Search ..... 114/55.5, 55.57, 114/363

[56] References Cited

U.S. PATENT DOCUMENTS 5,355,826 10/1994 Hattori et al. ..... 114/55.57

FOREIGN PATENT DOCUMENTS

61/57486 3/1986 Japan ..... 114/55.57

61-291292 12/1986 Japan .

2-3-4637 2/1991 Japan .

9-323696 12/1997 Japan .

*Primary Examiner*—Ed Swinehart

*Attorney, Agent, or Firm*—Oliff & Berridge, PLC

[57] ABSTRACT

A deck floor for a personal watercraft establishes the foot placement based on the body build of the driver without the soles of the feet being bent back. The deck floor includes: a pair of floor faces with a floor face positioned on each side of a seat, a pair of step faces formed ahead of the floor faces, and a pair of intermediate step faces formed between the floor faces and the step faces. Each floor face includes a first plane portion which is substantially horizontal and is continuous to the intermediate step face, and the step face includes a second plane portion which also is continuous to the intermediate step face and is inclined forwardly and upwardly. The intermediate step face is a plane which is inclined at a middle inclined angle between an inclined angle of the first plane portion and an inclined angle of the second plane portion.

17 Claims, 6 Drawing Sheets

DECK FLOOR FOR PERSONAL WATERCRAFT

BACKGROUND OF THE INVENTION

1. Field of the Invention

The invention relates to a personal watercraft (also called a PWC) that planes along the surface of the water, and more particularly to a deck floor for the personal watercraft.

2. Description of Related Art

Personal watercraft have been gaining popularity in recent years for sports and recreational purposes. Generally, the personal watercraft is constructed to thrust forward by increasing the pressure of water drawn through a water intake provided on a bottom of a body of the watercraft by means of a propulsion pump and ejecting the water rearward from the body.

Further, a seat is formed to protrude upwardly from a deck floor at a central portion in a direction of a width of the personal watercraft and to extend in a direction of a length of the personal watercraft. A handlebar is provided in front of the seat, and the deck floor is formed on both sides of the seat.

The driver of the personal watercraft operates the personal watercraft in a posture in which he/she sits astride the seat, holds the handlebar for steering, and places the soles of feet on the deck floor acting as a space for patting the feet.

FIGS. 6*a* and 6*b* are side views showing a conventional personal watercraft together with a driver. The driver shown in FIG. 6*a* is a small person and has shorter legs as compared with the driver shown in FIG. 6*b*. The soles of the feet of the driver shown in FIG. 6*a* are placed on a floor face 122, and the toe tips of the soles are positioned on a boundary between the floor face 122 and a step face 124. The legs of the driver are bent at an angle of about 90 degrees. When the driver operates the personal watercraft in a relaxed posture, it is desirable that the legs should be thus bent at an angle of about 90 degrees and that an angle of the ankles should become about 90 degrees.

In a case where the driver is a large person and has long legs, the legs are bent at an acute angle if the soles of feet are placed on the floor face 122. Consequently, the driver cannot have a comfortable or desirable operating posture with the legs in such a position. Thus, a driver having long legs often operates the personal watercraft in a posture in which the soles of the feet are placed on the step face 124 with the heels positioned on the boundary between the floor face 122 and the step face 124 as shown in FIG. 6*b*.

In a case where the driver is a mid-sized person and tries to take such a relaxed posture as obtained by both tall and short drivers, the soles of the feet overlap the boundary between the floor face 122 and the step face 124. A mid-sized person is a person who has intermediate build between that of a large person and that of a small person. The boundary is a portion where the floor face 122 and the step face 124 continue through a V-shaped interior angle. Thus, the portion where the feet of a mid-sized person would comfortably fit has a V-shape. Therefore, the soles of the feet are bent back so that the driver is uncomfortable and becomes fatigued.

Japanese Utility Model Publication No. Hei 3-4637 discloses the related art of a deck floor.

SUMMARY OF THE INVENTION

In consideration of the above-mentioned circumstances, it is an object of the invention to provide a deck floor for a personal watercraft capable of providing positions for the driver's feet for all builds of drivers without the soles of the feet being bent back.

The invention provides a deck floor for a personal watercraft in which a seat is formed to protrude upwardly from the deck floor at a central portion in a direction of a width of the personal watercraft and to extend in a direction of a length of the personal watercraft. A handlebar is provided in front of the seat. The deck floor includes a pair of floor faces positioned on both sides of the seat, a pair of step faces formed ahead of the floor faces, and a pair of intermediate step faces formed between the floor faces and the step faces. The floor faces include first plane portions which are almost horizontal and continue to the intermediate step faces, the step faces include second plane portions which continue to the intermediate step faces and are inclined to be raised forward, and the intermediate step faces are planes which are inclined at a middle inclined angle between an inclined angle of the first plane portions and an inclined angle of the second plane portions.

According to the deck floor for the personal watercraft, the positioning movement of the driver's feet can be performed smoothly using the intermediate step face. Consequently, the degree of freedom of position selection can be enhanced. In particular, the intermediate step face can be a position on which a driver who is a mid-sized person can put his/her feet in a relaxed steering posture.

It is preferable that the intermediate step face should have a length of 10 cm to 50 cm in order to provide an appropriate position for the feet and to obtain a relaxed state, depending on the build of the driver.

In order to perform more smoothly the positioning movement of the feet between the first plane portion and the intermediate step face, it is preferable that the first plane portion and the intermediate step face should continue through a first arc-shaped portion formed by a fillet, the first arc-shaped portion having, a radius of curvature of 10 cm to 200 cm.

In order to obtain a smooth and continuous connection of the intermediate step face with the step face, it is preferable that the intermediate step face and the second plane portion should continue through a second arc-shaped portion formed by a fillet, the second arc-shaped portion having a radius of curvature of 20 cm or less.

It is preferable that the intermediate step faces are formed in such a manner that they are positioned approximately on both sides of the handlebar.

These objects as well as other objects, features and advantages of the invention will become more apparent to those skilled in the art from the following description with reference to the accompanying drawings.

DETAILED DESCRIPTION OF PREFERRED EMBODIMENTS

Figure 1:
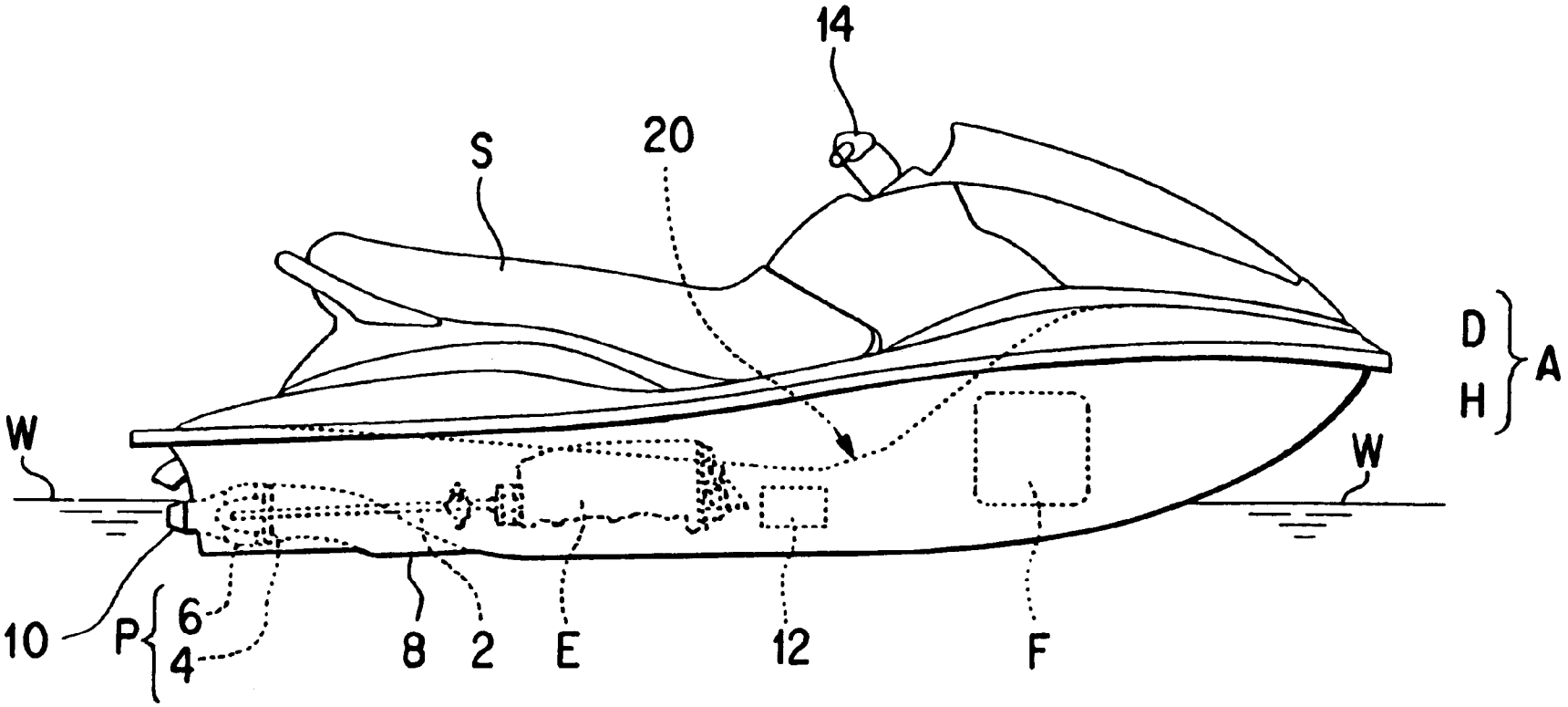
FIG. 1 is a side view showing a personal watercraft employing a deck floor according to an embodiment of the invention.
Figure 2:
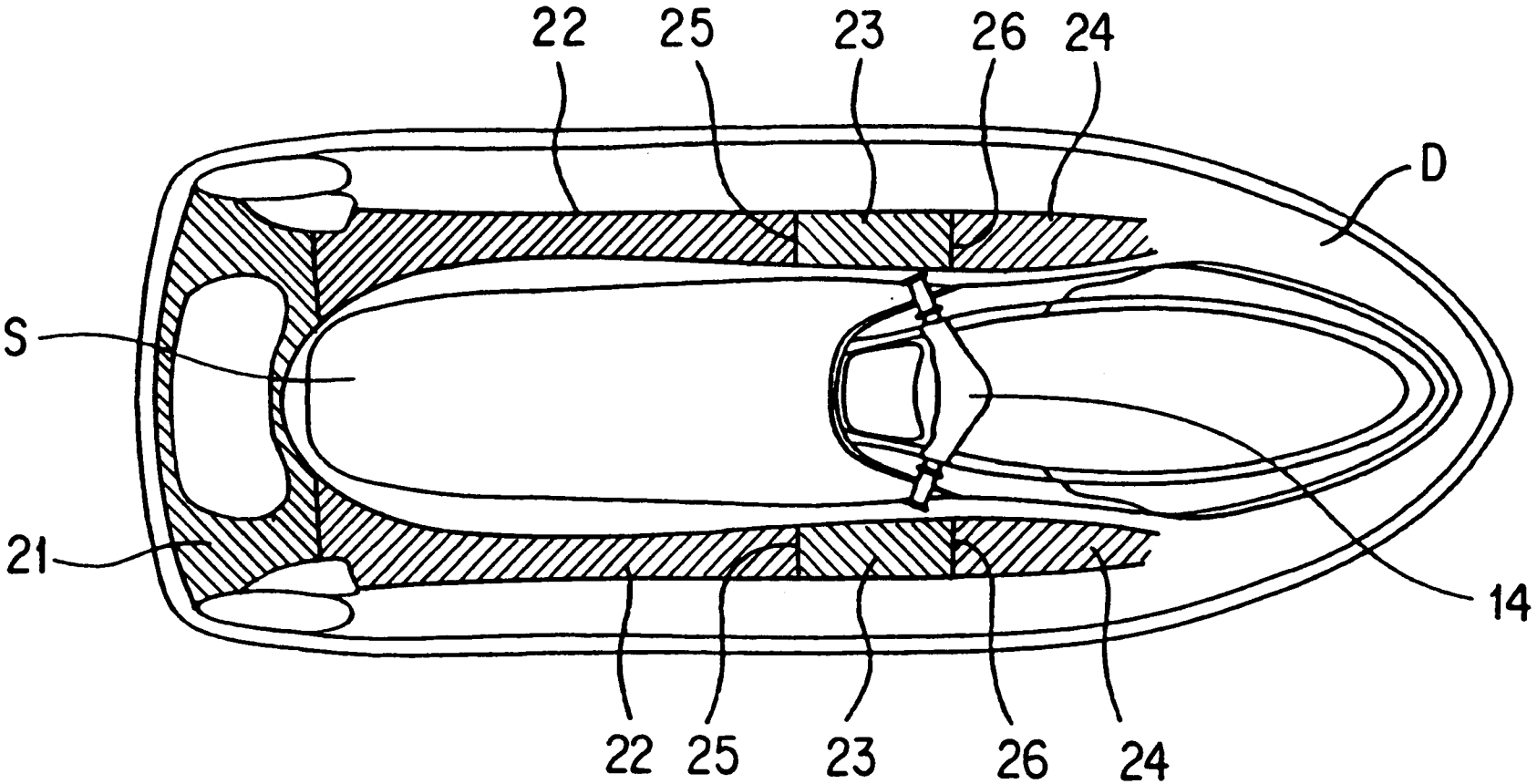
FIG. 2 is a plan view showing the personal watercraft in FIG. 1.

A deck floor for a personal watercraft according to an embodiment of the invention will be described below with reference to the drawings. FIG. 1 is a side view showing a personal watercraft employing the deck floor according to the embodiment, and FIG. 2 is a plan view of the same. In FIGS. 1 and 2, the personal watercraft is shown floating on the water, where W indicates the surface of the water, and A indicates a body of the personal watercraft. The body A comprises a hull H and a deck D covering an upper side of the hull H. The personal watercraft is equipped with an engine E as a power source, and the rotation of the engine E is transmitted to an impeller 4 via a drive shaft 2. The impeller 4, together with a casing 6 provided around the outer circumference thereof, constitutes a propulsion pump P. The personal watercraft is constructed in such a manner that the water drawn through a water intake 8 provided on a bottom is pressurized by the propulsion pump P and the water is ejected rearward through a jet nozzle, thereby producing propulsive force. The jet nozzle is covered by a steering nozzle 10 located further rearward. The reference numeral 12 indicates an electrical unit including electrical equipment for supplying electric power for ignition to a spark plug of the engine, E, or the like. F indicates a fuel tank.

The mounting position of the engine varies depending on the type of the personal watercraft. In the present embodiment, the engine E is mounted beneath a seat S. In other words, the seat S is located above an engine room where the engine E is accommodated. A deck floor 20 is formed on the deck D. A thin mat made of synthetic resin (not shown) is laid over a surface of the deck floor 20. The seat S is formed to protrude upwardly from the deck 20 at a central portion in a direction of a width of the personal watercraft and to extend in a direction of a length of the personal watercraft. Handlebar 14 for steering is mounted in front of the seat S. When the handlebar 14 is steered to the right or left, the steering nozzle 10 swings to the right or left so that the personal watercraft can be steered in a desired direction. A reverse deflector (not shown) which is turnable downward about a horizontal support shaft is provided above the steering nozzle 10 and further rearward. By turning the deflector to a lower position rearward of the steering nozzle 10 and thereby causing the water ejected rearward from the steering nozzle 10 to turn toward the front, the personal watercraft can be moved in a reverse direction.

Figure 3:
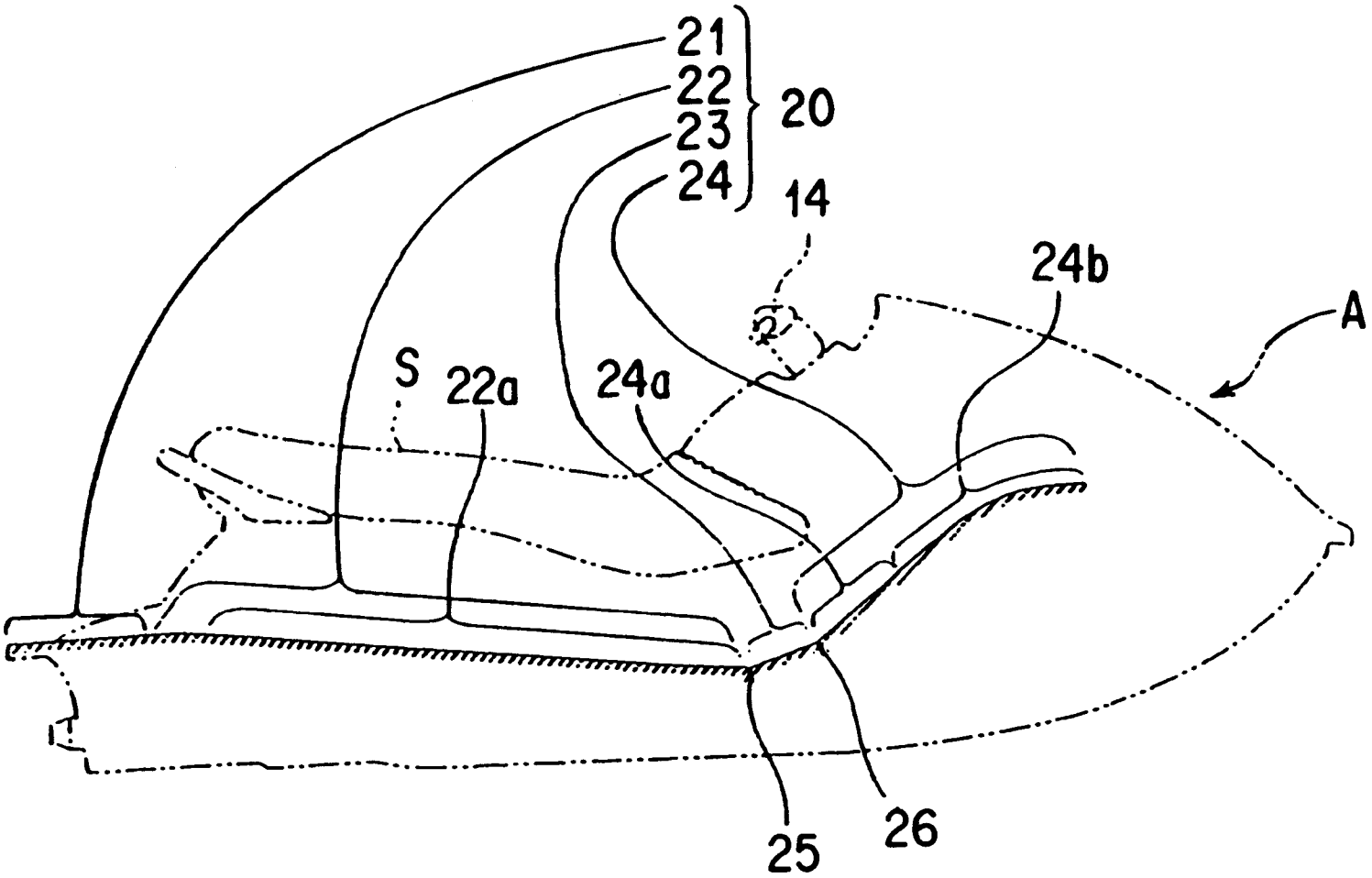
FIG. 3 is a view representing a longitudinal sectional shape of the deck floor.

FIG. 3 is a view representing a longitudinal shape of the deck floor 20. The deck floor 20 comprises a rear deck face 21, a pair of right and left floor faces 22, a pair of right and left intermediate step faces 23 and a pair of right and left step faces 24, and is wholly formed to surround both sides of the seat S and a rear portion thereof.

The floor face 22 is formed on right and left sides of the seat S. A planar portion is formed over almost the entire length of the floor face 22. The planar portion is represented by a first plane portion 22*a*. A front end of the first plane portion 22*a* continues to the intermediate step face 23 positioned on each side of the handlebar 14. The intermediate step face 23 is thus formed on both sides of the handlebar 14 because the position is suitable for a driver who is a mid-sized person. The mid-sized person will be described later. A first arc-shaped portion 25 is formed by a fillet on a boundary between the first plane portion 22*a* and the intermediate step face 23. While it is desirable that the first arc-shaped portion 25 should have a radius of curvature of 10 cm to 200 cm, the first arc-shaped portion 25 has a radius of curvature of 140 cm in the embodiment. The intermediate step face 23 is planar. It is desirable that the intermediate step face 23 should have a length which is a little greater than the size of the driver's foot (from toe tip to heel). More specifically, it is desirable that a longitudinal length should be 10 cm to 50 cm. In the present embodiment, the longitudinal length is 30 cm. The step face 24 is formed ahead of the intermediate step face 23. The step face 24 is formed by a second plane portion 24*a* and a curved face portion 24*b*. A front end of the intermediate step face 23 continues to a rear end of the second plane portion 24*a*. A second arc-shaped portion 26 is formed by a fillet on a boundary between the intermediate step face 23 and the second plane portion 24*a*. It is desirable that the second arc-shaped portion 26 should have a radius of curvature of 20 cm or less. In the present embodiment, the radius of curvature is 10 cm. A rear end of the floor face 22 continues to the rear deck face 21.

The first plane portion 22*a* of the floor face 22 has little to no inclination, that is, it is provided almost horizontally. The second plane portion 24*a* of the step face 24 is inclined to be raised forward. The intermediate step face 23 is inclined at a middle inclined angle between an inclined angle of the first plane portion 22*a* and an inclined angle of the second plane portion 24*a*. The inclined angle of a plane or a face means an angle at which the plane or the face is inclined to a horizontal plane.

Figure 4:
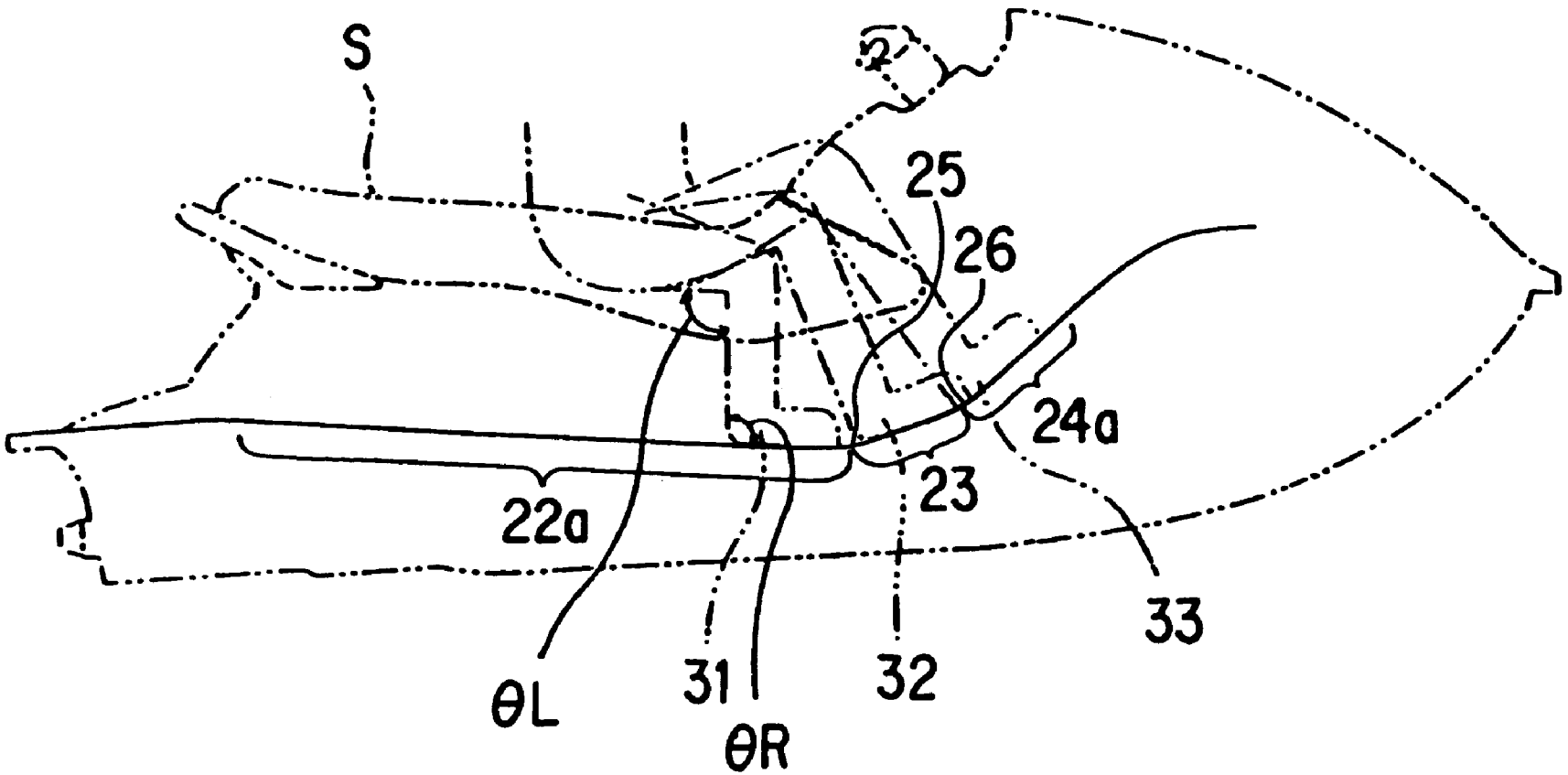
FIG. 4 is a view showing the placement of the feet obtained when a driver sits astride the seat of the personal watercraft in a relaxed steering posture.

FIG. 4 is a view showing the placement of feet which is obtained when a driver sits astride the seat S of the personal watercraft in a relaxed steering posture. The reference numeral 31 indicates the foot placement for a driver who is a small person and has short legs. Reference numeral 33 indicates the foot placement for a driver who is a large person and has long legs. Reference numeral 32 indicates the foot placement for a driver who is a mid-sized person and has legs having average lengths. θL, θR indicate a bent angle of the driver's leg and an angle of the driver's ankle respectively.

As seen from FIG. 4, a driver having short legs can take a relaxed steering posture by placing the soles of his/her feet on the first plane portion 22*a* of the floor face 22, as indicated by 31, to bend the legs and ankles at an angle of about 90 degrees. A driver having long legs can take a relaxed steering posture by placing the soles of his/her feet on the second plane portion 24*a* of the step face 24, as indicated by 33, to bend the legs and ankles at an angle of about 90 degrees. Furthermore, a driver having mid-length legs can obtain a relaxed steering posture by placing the soles of his/her feet on the intermediate step face 23, as indicated by 32, to also bend the legs and ankles at an angle of about 90 degrees. Thus, a driver can optionally select the position to place his/her feet depending on his/her build and the length of his/her legs. The driver usually searches for the optimum position for placing his/her feet while sliding the feet forward and rearward on the deck floor 20. The first arc-shaped portion 25 having a comparatively large radius of curvature is formed on the boundary between the floor face 22 and the intermediate step face 23 in such a manner that a definite V-shaped interior angle is not sensed. The result is the positioning movement of the feet can be performed smoothly. More specifically, if the arc-shaped portion is not formed, but the definite V-shaped interior angle is formed, the driver has a hitch feeling so that smooth positioning movement cannot be performed. On the other hand, when the floor face 22 and the intermediate step face 23 have an arclike shape integrating them, they are not fitted to the shapes of the soles of the feet. Therefore, the driver feels uncomfortable and fatigued if the feet are placed on this arc. By causing two planes, the first plane portion 22*a* and the intermediate step face 23, to continue through the first arc-shaped portion 25, the hitch feeling is eliminated. Consequently, the positioning movement can be performed smoothly between the floor face 22 and the intermediate step face 23.

On the other hand, the second arc-shaped portion 26 formed on the boundary between the intermediate step face 23 and the step face 24 has a comparatively small radius of curvature. Accordingly, a definite interior angle can be formed between the intermediate step face 23 and the step face 24. Therefore, the toe tips of the driver's feet put on the intermediate step face 23 can feel the step face 24, thereby the position of the feet can be confirmed. Alternatively, the heels of the feet put on the step face 24 can touch the intermediate step face 23, thereby the position of the feet can be confirmed and the feet can be supported by the intermediate step face 23.

Further, the floor face 22 and intermediate step 23 are smoothly continuous through the first arc-shaped portion 25, and the intermediate step 23 and the step face 24 are smoothly continuous through the second arc-shaped portion 26. Such a structure is convenient in manufacturing the deck D as a molded product and particularly has merit that a shrinkage cavity is not generated at portions in front of and behind the portions 25, 26 when the deck D is molded as a resin product.

Figure 5:
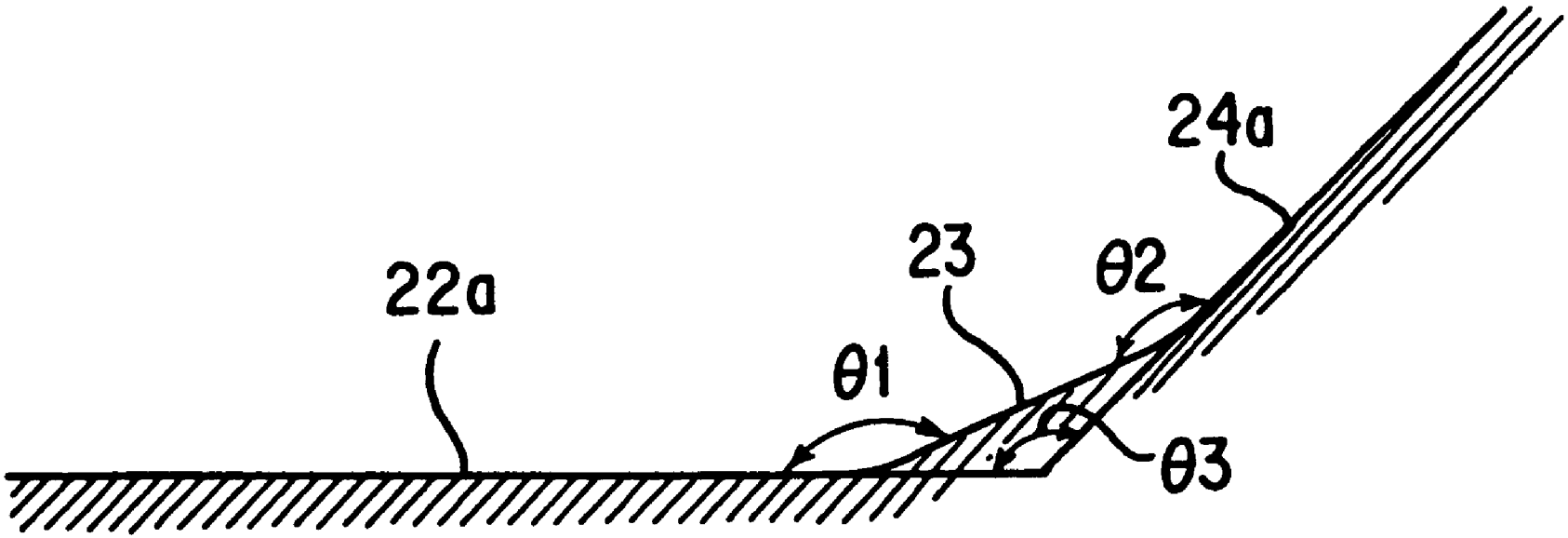
FIG. 5 is a diagram for comparing interior angles formed by a first plane portion and an intermediate step face and by the intermediate step face and a second plane portion with an interior angle formed by the first plane portion and the second plane portion.
Figure 6A:
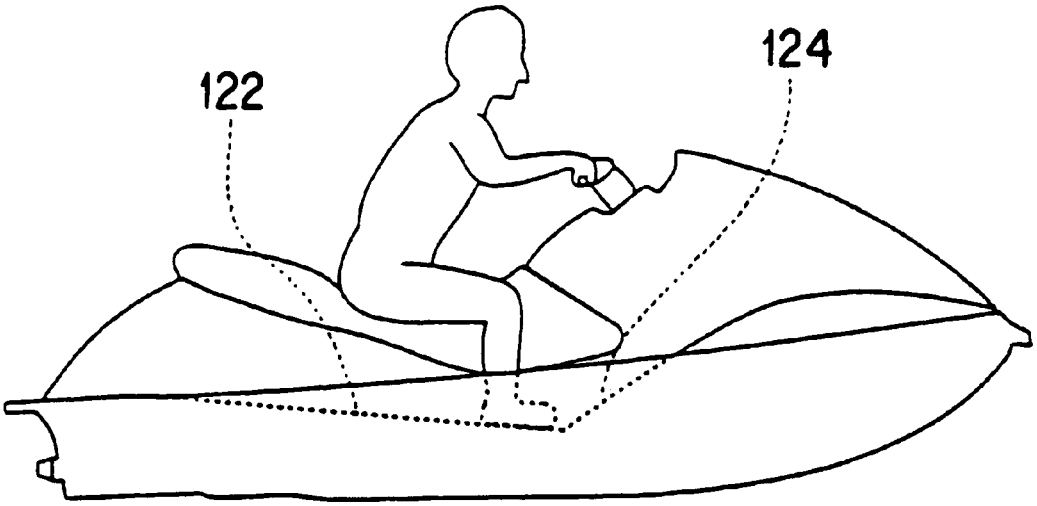
FIG. 6a PRIOR ART
FIG. 6*a* is a side view showing a personal watercraft according to the prior art together with a driver who is a small person and has short legs.
Figure 6B:
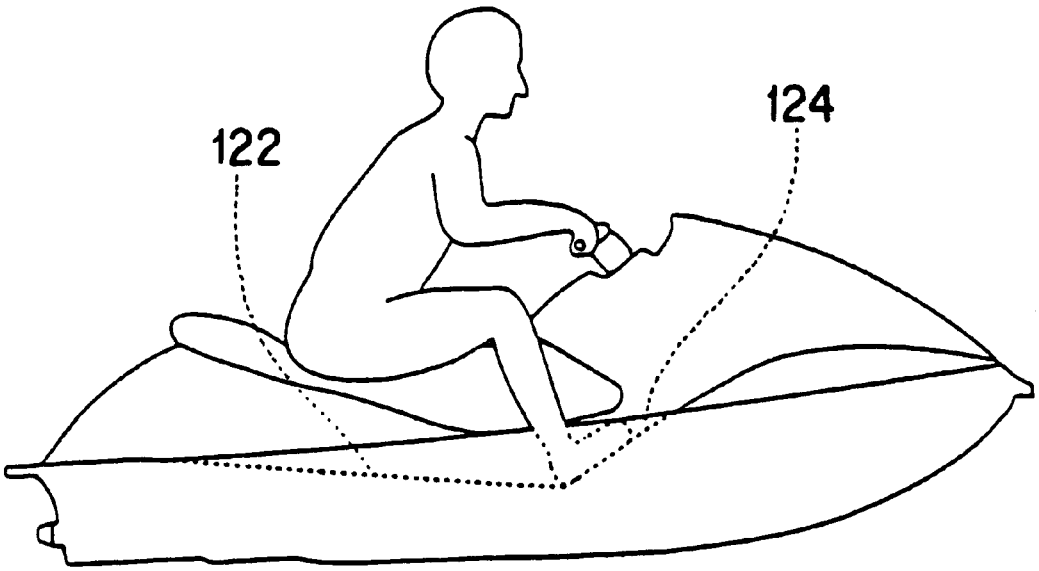
FIG. 6b PRIOR ART
FIG. 6*b* is a side view showing a personal watercraft according to the prior art together with a driver who is a large person and has long legs.

As shown in FIG. 5, the interior angle θ1 formed by the first plane portion 22*a* and the intermediate step face 23 and the interior angle θ2 formed by the intermediate step face 23 and the second plane portion 24*a* are each greater than the interior angle θ3 formed by the first plane portion 22*a* and the second plane portion 24*a*. Conventionally, the positioning movement of the feet has been performed through the interior angle θ3. In the personal watercraft according to the embodiment, the positioning movement of the feet may be performed through the greater interior angles θ1 and θ2. Accordingly, the positions of the feet can be selected by smoothly moving the feet to the floor face 22, the intermediate step face 23 and the step face 24.

Thus, the position where the driver who is mid-sized can put his/her feet is provided between the floor face 22 and the step face 24 by the intermediate step face 23. Moreover, because the portions where the feet are to be put are planes, the driver can take a relaxed steering posture without feeling uncomfortable and becoming fatigued. Furthermore, since three step faces are provided, the driver can set the angles of the legs and ankles depending on his/her preference comparatively freely. As the interior angles θ1, θ2 are comparatively large and the arc-shaped portions 25, 26 are formed between the planes, the soles of the feel are less bent back so that the driver feels less fatigued even if the feet are placed on the boundary portion between the floor face 22 and the intermediate step face 23 or the boundary portion between the intermediate step face 23 and the step face 24.

Further, as shown in FIG. 1, electrical equipment 12 or the like is often provided in the vicinity of the boundary between the floor face 22 and the step face 24. In this case, a space for providing the electrical equipment 12 or the like can be enlarged by forming the intermediate step face 23 as in the embodiment.

Although the first plane portion 22*a* has occupied most of the floor face 22 in the embodiment, it accomplishes its purpose if it has a size equal to or greater than the size of an adult's foot (from toe tip to heel).

For purposes of description, the word "segment" equates to "face" when addressing rest positions for the feet and "transition zone" equates to "arc-shaped portion" when addressing the curvilinear areas between the foot rest positions.

Numerous modifications and alternative embodiments of the invention will be apparent to those skilled in the art in view of the foregoing description. Accordingly, this description is to be construed as illustrative only, and is provided for the purpose of teaching those skilled in the art the best mode of carrying out the invention. The details of the structure and/or function may be varied substantially without departing from the spirit of the invention.

What is claimed is:

1. A deck floor for a personal watercraft in which a seat is formed to protrude upwardly from the deck floor at a central portion in a direction of a width of the personal watercraft and to extend in a direction of a length of the personal watercraft, and a handlebar is provided in front of the seat, the deck floor comprising:

a pair of floor faces positioned so that one of the pair of floor faces is on each side of the seat, each one of the floor faces receiving a sole of a foot of an operator to establish a steering posture;

a pair of step faces such that one of the pair of step faces is formed forward of each of the floor faces, each one of the floor faces receiving the sole of the foot of the operator to establish a steering posture;

a pair of intermediate step faces such that one of the pair of intermediate step faces is formed between each of the floor faces and the step faces, each one of the intermediate step faces receiving the sole of the foot of the operator to establish a steering posture, wherein the floor faces include first plane portions which are substantially horizontal and continue to the intermediate step faces, the step faces include second plane portions which continue to the intermediate step faces and are inclined to be raised forward, and the intermediate step faces are planes which are inclined at a middle inclined angle between an inclined angle of the first plane portions and an inclined angle of the second plane portions.

2. The deck floor for a personal watercraft according to claim 1, wherein each of the intermediate step faces has a length of 10 cm to 50 cm.

3. The deck floor for a personal watercraft according to claim 1, wherein the first plane portion and the intermediate step face on each side of the seat continue through a first arc-shaped portion formed by a fillet, the first arc-shaped portion having a radius of curvature of 10 cm to 200 cm.

4. The deck floor for a personal watercraft according to claim 1, wherein the intermediate step face and the second plane portion on each side of the seat continue through a second arc-shaped portion formed by a fillet, the second arc-shaped portion having a radius of curvature of 20 cm or less.

5. The deck floor for a personal watercraft according to claim 1, wherein the intermediate step face is positioned approximately on each side of the handlebar.

6. A personal watercraft, comprising:

a hull;

a deck mounted to the hull to form a body, the deck comprising:

a seat aligned along a centerline of the hull; and a deck floor having a foot placement area on each side of the seat, each foot placement area having at least three segments from stern to bow, the at least three segments including a first substantially horizontal segment, a second segment extending upwardly from the first segment at a first obtuse angle, and a third segment extending from the second segment at a second obtuse angle.

7. The personal watercraft according to claim 6, wherein the first segment lies in a substantially horizontal plane.

8. The personal watercraft according to claim 6, further comprising a curvilinear transition zone between the first segment and the second segment.

9. The personal watercraft according to claim 8, wherein the curvilinear transition zone has a radius of curvature between 10 and 200 cm.

10. The personal watercraft according to claim 9, wherein the radius of curvature is substantially 140 cm.

11. The personal watercraft according to claim 8, further comprising a second curvilinear transition zone between the second segment and the third segment.

12. The personal watercraft according to claim 11, wherein a radius of curvature of the second transition zone is no greater than 20 cm.

13. The personal watercraft according to claim 12, wherein the radius of curvature of the second transition zone is substantially 10 cm.

14. The personal watercraft according to claim 11, wherein the second segment has a length between 10 and 50 cm.

15. The personal watercraft according to claim 14, wherein the length of the second segment is substantially 30 cm.

16. The personal watercraft according to claim 6, further comprising a handlebar mounted to the body forward of the seat, the second segments substantially aligned with the handle bars to starboard and port.

17. The personal watercraft according to claim 6, wherein the first obtuse angle between the first segment and the second segment and the obtuse angle between the second segment and the third segment are greater than a third obtuse angle defined by an intersection of a plane parallel to and passing through the first segment and a plane parallel to and passing through the third segment.

* * * * *